US007316625B2

(12) United States Patent
Takahashi

(10) Patent No.: US 7,316,625 B2
(45) Date of Patent: Jan. 8, 2008

(54) ARROW WITH LIGHT EMITTING FUNCTION, NOCK WITH LIGHT EMITTING FUNCTION, AND LIGHT EMISSION CONTROL DEVICE TO BE USED IN ARROW TECHNICAL FIELD

(76) Inventor: Yasuhiro Takahashi, 5410, Ooaza-Shimohebaru, Tatibana-Machi, Yame-Gun, Fukuoka (JP) 8340073

( * ) Notice: Subject to any disclaimer, the term of this patent is extended or adjusted under 35 U.S.C. 154(b) by 164 days.

(21) Appl. No.: 10/544,554

(22) PCT Filed: May 21, 2004

(86) PCT No.: PCT/JP2004/006950

§ 371 (c)(1),
(2), (4) Date: Sep. 15, 2005

(87) PCT Pub. No.: WO2005/114090

PCT Pub. Date: Dec. 1, 2005

(65) Prior Publication Data

US 2007/0105667 A1 May 10, 2007

(51) Int. Cl.
*F42B 6/04* (2006.01)

(52) U.S. Cl. ..... 473/578; 473/570

(58) Field of Classification Search ..... 473/570, 473/578

See application file for complete search history.

(56) References Cited

U.S. PATENT DOCUMENTS

| | | | | |
|---|---|---|---|---|
| 4,340,930 | A | 7/1982 | Carissimi | |
| 4,989,881 | A | 2/1991 | Gamble | |
| 5,134,552 | A * | 7/1992 | Call et al. | 362/203 |
| 5,141,229 | A | 8/1992 | Roundy | |
| 6,123,631 | A | 9/2000 | Ginder | |
| 6,390,642 | B1 * | 5/2002 | Simonton | 362/203 |
| 6,533,688 | B1 * | 3/2003 | Huang | 473/578 |
| 6,736,742 | B2 * | 5/2004 | Price et al. | 473/570 |
| 6,758,773 | B1 * | 7/2004 | Liao et al. | 473/578 |
| 7,021,784 | B2 * | 4/2006 | DiCarlo | 362/109 |

FOREIGN PATENT DOCUMENTS

| | | |
|---|---|---|
| JP | 51-63755 | 6/1976 |
| JP | 2003-035500 | 2/2003 |

* cited by examiner

*Primary Examiner*—John A. Ricci
(74) *Attorney, Agent, or Firm*—Jordan and Hamburg LLP

(57) ABSTRACT

An arrow is provided with a light emitting function, a nock with a light emitting function, and a light emission control device to be used in an arrow which thereby realize accurate and stable light emission periods of time and a reduction in size and weight of light emitting members by using an electronic circuit with an acceleration sensor switch in its light emission control part. The control device includes an acceleration switch, a capacitor circuit including a capacitor and a resistor, and an electrical circuit installed inside the arrow, nock, or attachable to and detachable from the arrow. Electricity is applied when the arrow is discharged from a bow to emit light for a set period of time.

12 Claims, 4 Drawing Sheets

ARROW WITH LIGHT EMITTING FUNCTION, NOCK WITH LIGHT EMITTING FUNCTION, AND LIGHT EMISSION CONTROL DEVICE TO BE USED IN ARROW

TECHNICAL FIELD

BACKGROUND OF THE INVENTION

1. Technical Field

The present invention relates to an arrow and nock with a light emitting function. More specifically, the present invention relates to an arrow with a light emitting function, a nock with a light emitting function, and a light emission control device to be used in the arrow, which make it possible for a shooter to confirm whether an arrow discharged by the shooter hit the target or not.

2. Background Art

As sports and games for discharging arrows toward targets, there is kyudo, archery, bowgun (crossbow), darts, etc.

For example, kyudo is normally divided into near-target events with a shooting distance of 28 m and distant-target events with a shooting distance of 60 m, and in both events, a circular target is shot by an arrow.

In archery, mainly, an 18 m shooting distance is set for indoor games, and for outdoor games, 30 m, 50 m, and 90 m shooting distances are set.

Dart games are made competitive by scoring points by throwing darts directly by hand without using a bow, and recently, dart enthusiasts have been increasing in Japan as well.

It is visually checked by a shooter him/herself during training or by a judge during matches whether an arrow of these has hit the target or not.

However, in outdoor playing fields, it becomes difficult to visually check the striking point of the arrow when the sun goes down and twilight occurs, and it takes time to determine the next shooting direction of an arrow, and this causes loss of the rhythm and makes it difficult for a shooter to concentrate on training.

An invention shown in FIG. 7 has been proposed for solving this problem. According to this invention, the arrow 101 has a light emitting device 103 for illuminating the nock main body 102 when it hits the target or ground, etc. Inside the light emitting device 103, a battery 104 is fixed, and to the negative electrode terminal 105 of the battery 104, a lead wire as a negative electrode conductor extending from the light emitting diode 106 is connected. On the other hand, to the front end of a lead wire as a positive electrode conductor from the light emitting diode 106 and to the front end of a lead wire as a positive electrode conductor to be connected to the positive electrode terminal of the battery 104, switch opening and closing pieces 108 that form a switching device provided in a second space 107 are connected. The switch opening and closing pieces 108 are fixed at their base portions while being in contact with each other, and a switch operator 109 that opens and closes the switch opening and closing pieces 108 is provided so as to advance and retreat inside the second space 107 and the first space 110. The front end of the operating part 112 of this switch operator 109 enters between the switch opening and closing pieces 108 before discharging an arrow by an urging force of a coil spring 111 provided inside the first space 110, and the electric conduction path is shut off.

In addition, at the front end of the light emitting device 103, an air exhaust hole 113 is provided for mainly exhausting air in the first space 110 to the outside of the light emitting device 103. In this air exhaust hole 113, a check valve is provided to prevent air flow from the outside although allowing the air in the first space 110 to be exhausted.

Furthermore, an air introducing hole 114 with a diameter smaller than the diameter of the air exhaust hole 113 is provided around the air exhaust hole 113. In the light emitting device thus constructed, when an arrow is discharged and hits the target or ground, etc., the switch operator 109 moves toward the arrow front end by inertia against the urging force of the coil spring 111, whereby the air inside the first space 111 becomes high in pressure and is exhausted from the air exhaust hole 113, the operating part 112 is separated from the switch opening and closing pieces 108, and the light emitting diode 106 emits light. Then, when the switch operator 109 is about to be pushed back by the urging force of the coil spring 111, in the air exhaust hole 113, air flow into the first space 110 is prevented by the check valve so as to gain as much time as possible until air flows-in only from the air introducing hole 114, the switch opening and closing pieces 108 return to the original positions, and the electric conduction path is shut off, and during this period of time, the light emitting diode 106 is made to emit light. See Japanese Unexamined Patent Publication No. 2003-35500.

SUMMARY OF THE INVENTION

According to the invention, even in a case where the sun goes down and twilight occurs or a shooter has reduced visual acuity, it becomes possible for the shooter to confirm the position an arrow arrives since the nock is illuminated by a light emitting means when the shooter discharges an arrow and the arrow hits a target or the ground, etc.

However, the light emitting means of the nock conducts electricity by separating the operating part 112 from the switch opening and closing pieces 108 by inertia of the switch operator 109 itself when the arrow 101 hits and stops, and makes the light emitting diode 106 emit light, so that the parts are worn out according to the number of times of use of the arrow and this changes the period of light emission and causes the switch part to be broken, and therefore there is a problem that stable accuracy cannot be maintained.

In addition, the light emitting means emits light when the arrow discharged by a shooter hits a target or the ground, etc., so that the locus of the arrow until it hits the target cannot be confirmed, and when several shooters shoot, it cannot be confirmed where the arrows came from by light emission after the arrows hit the target.

The present invention was made in view of the above-described circumstances, and an object thereof is to provide an arrow with a light emitting function, a nock with a light emitting function, and a light emission control device to be used for an arrow, which realizes stable and accurate light emission periods and reduction in size and weight of the light emitting members by using an electronic circuit using an acceleration sensor switch in the light emission control part.

In order to achieve the object, an arrow with a light emitting function of the invention has a light emission control part that emits light when the arrow is discharged, wherein the light emission control part includes an electrical circuit in which an acceleration sensor switch that starts by the arrow acceleration, a light source provided at a position of the arrow visible to a shooter, and a battery for supplying a current to the light source when the acceleration sensor switch starts, and a capacitor circuit to be supplied with a current for a predetermined period after the acceleration sensor switch is turned off are installed.

Herein, the light emission control part to be installed in the arrow includes an electronic circuit having a light emitting diode serving as a light source, a battery, an acceleration sensor switch, and a capacitor circuit. This acceleration sensor switch is turned on by an acceleration (approximately 200 G) applied when the arrow is discharged from the bow, and causes the light emitting diode to emit light while the capacitor circuit 15 is charged.

Even when the arrow leaves the bow and turns into constant-speed flight and the acceleration sensor switch is turned off, light is emitted for a predetermined period of time by discharging a current charged in the capacitor circuit, whereby it becomes possible to confirm where the arrow hits.

In addition, to achieve the above-mentioned object, a nock with a light emitting function relating to the invention is a nock provided in an arrow, having a light emission control part that emits light when the arrow is discharged, wherein the light emission control part has an electrical circuit in which an acceleration sensor switch that starts by an acceleration of the arrow, a light source provided in the nock, a battery for supplying a current to the light source when the acceleration sensor switch starts, and a capacitor circuit to which a current is supplied for a predetermined period of time after the acceleration sensor switch is turned off are installed.

Herein, the light emission control part to be installed in the nock attached to the rear end of the arrow main body includes an electronic circuit formed of a light emitting diode serving as a light source, a battery, an acceleration sensor switch, and a capacitor circuit.

Therefore, the acceleration sensor switch is turned on by an acceleration when the arrow is discharged, the light source of the light emitting diode emits light, and the capacitor circuit is charged. Then, when the arrow leaves the bow and the acceleration sensor switch is turned off, a current is discharged from the capacitor circuit to make the light emitting diode emit light for a predetermined period of time.

In addition, to achieve the above-mentioned object, a light emission control device to be used for the arrow of the invention is a light emission control device to be attached to the arrow, and the light emission control device has an electrical circuit including an acceleration sensor switch that starts by an acceleration of the arrow, a light source that emits light when the arrow is discharged, a battery for supplying a current to the light source by the start of the acceleration sensor switch, and a capacitor circuit that is supplied with a current for a predetermined period of time after the acceleration sensor switch is turned off.

Herein, the light emission control device that is attachable to an arrow main body when the arrow is discharged is formed of an electronic circuit in which a light emitting diode serving as a light source, a battery, an acceleration sensor switch, and a capacitor circuit are installed.

Then, by an acceleration applied when the arrow is discharged from the bow, the acceleration sensor switch is turned on, the light emitting diode emits light, and the capacitor circuit is charged, and even when the arrow leaves the bow and the acceleration becomes zero and the acceleration switch is turned off, due to discharge from the capacitor circuit, the light emitting diode emits light for a predetermined period, whereby the locus of the arrow becomes visible even in the dark and it becomes possible to confirm where the arrow hits.

EFFECTS OF THE INVENTION

According to the arrow, the nock and the light emission control device of the invention described above, the electrical circuit is energized by an acceleration applied when a shooter discharges an arrow and the LED element emits light, and even after the arrow hits a target or the ground, etc., light is emitted for several seconds due to discharge from the capacitor, whereby it becomes possible to easily confirm the locus of the arrow and the position the arrow hit even in a dark playing field or a training field.

In addition, the electrical switch is not operated by mechanical operations, but is operated by using the acceleration applied to the arrow, so that erroneous operations and functional deterioration due to wearing according to the frequency of use are eliminated.

Furthermore, the electronic circuit includes an LED element, a transistor, and a capacitor, and is energized only while an acceleration is applied to the arrow, so that power consumption is very small and very economical.

DESCRIPTION OF THE PREFERRED EMBODIMENTS

Hereinafter, an embodiment of the invention is described with reference to the accompanying drawings for understanding of the invention.

Figure 1:
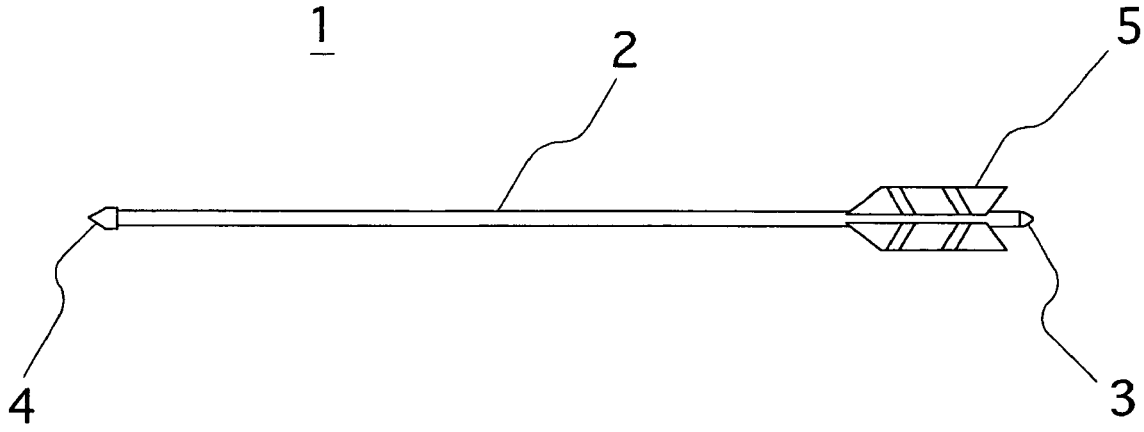
FIG. 1 is a side explanatory view showing an example of an arrow with a light emitting function to which the invention is applied.
Figure 2:
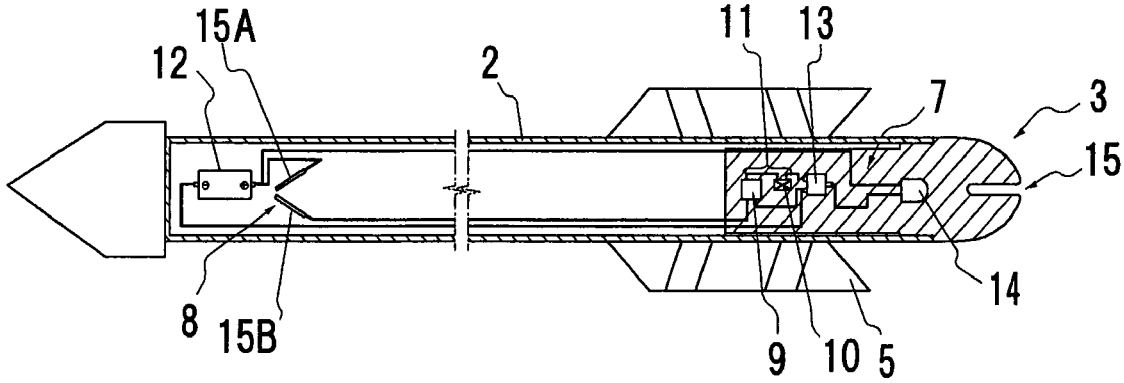
FIG. 2 is a sectional explanatory view showing the internal mechanism of FIG. 1.
Figure 3:
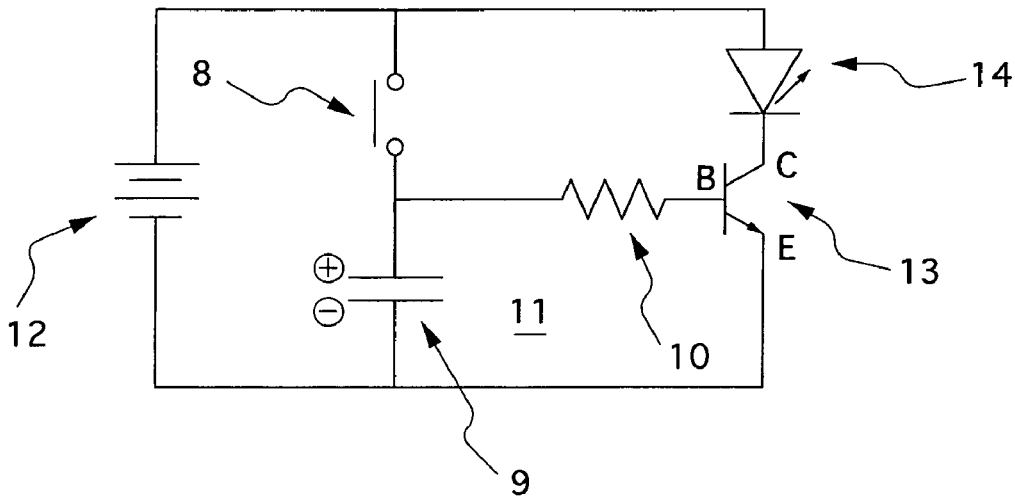
FIG. 3 is an electrical circuit diagram of FIG. 2.

FIG. 1 is a side explanatory view showing an example of an arrow with a light emitting function to which the invention is applied, FIG. 2 is an explanatory view showing the internal mechanism of FIG. 1, and FIG. 3 shows an electrical circuit of FIG. 2.

The arrow 1 shown herein includes a nock 3 attached to the rear end of an arrow shaft 2, an arrowhead 4, and fletchings 5.

Inside the arrow shaft 2, a light emission control part 7 is installed, and this light emission control part 7 includes an electrical circuit that has an acceleration switch 8, a capacitor circuit 11 composed of a capacitor 9 and a resistor 10, a lithium battery 12, a transistor 13, and an LED element 14.

Herein, the lithium battery 12 is disposed at the front end side inside the arrow shaft 2, and an acceleration switch 8 is provided at the rear portion of this lithium battery 12. This acceleration switch 8 has two thin metal plates 15A and 15B which are fixed at their rear ends and their front ends are separated from each other toward the arrow advancing direction. The metal plate 15A of the acceleration switch 8 is connected to the cathode side of the lithium battery 12 and the metal plate 15B is connected to the anode side of the lithium battery 12 via the capacitor circuit 11.

In addition, one terminal of the LED element 14 is connected to the anode side of the lithium battery 12 via a collector terminal of the transistor, and the other terminal of the LED element 14 is connected to the cathode side of the lithium battery. The base terminal of the transistor 13 is connected to the resistor 10 of the capacitor circuit 11, and the emitter terminal of the transistor 13 is connected to the anode side of the lithium battery 12.

Furthermore, the LED element 14 is fitted inside a transparent nock 3 provided at the rear end of the arrow shaft 2.

When the arrow is accelerated by the bow, the two thin metal plates 15A and 15B of the acceleration switch 8 bend inward due to inertia, and the metal plates 15A and 15B come into contact with each other, temporarily conduct electricity, and charge the capacitor 9 while making the LED element 14 emit light. Furthermore, when the arrow leaves the bow and the acceleration ends, the metal plates 15A and 15B restore due to their elasticity and cut electric conduction.

Next, electricity charged in the capacitor 9 flows into the base terminal of the transistor 13 through the resistor 10. During electric conduction to the base terminal of this transistor 13, the collector terminal and the emitter terminal of the transistor 13 conduct electricity, and the electricity flows from the cathode side of the lithium battery 12 to the LED element 14 side and makes the LED element 14 emit light, and passes through the transistor 13 and flows into the anode side of the lithium battery 12.

The period of electric conduction between the collector and the emitter of the transistor 13 as a period of light emission of the LED element 14 is determined by the period of electricity conduction to the base, and can be set by summing the capacitance of the capacitor 9 and the resistance value of the resistor 10.

The lithium battery does not always need to be installed in the front end side of the arrow shaft, however, by installing the lithium battery that is heaviest in the light emission control part in the front end side of the arrow shaft, its weight is well balanced with the LED element, transistor, and capacitor installed in the rear portion of the arrow shaft, whereby normal balance of the arrow can be maintained.

Figure 4:
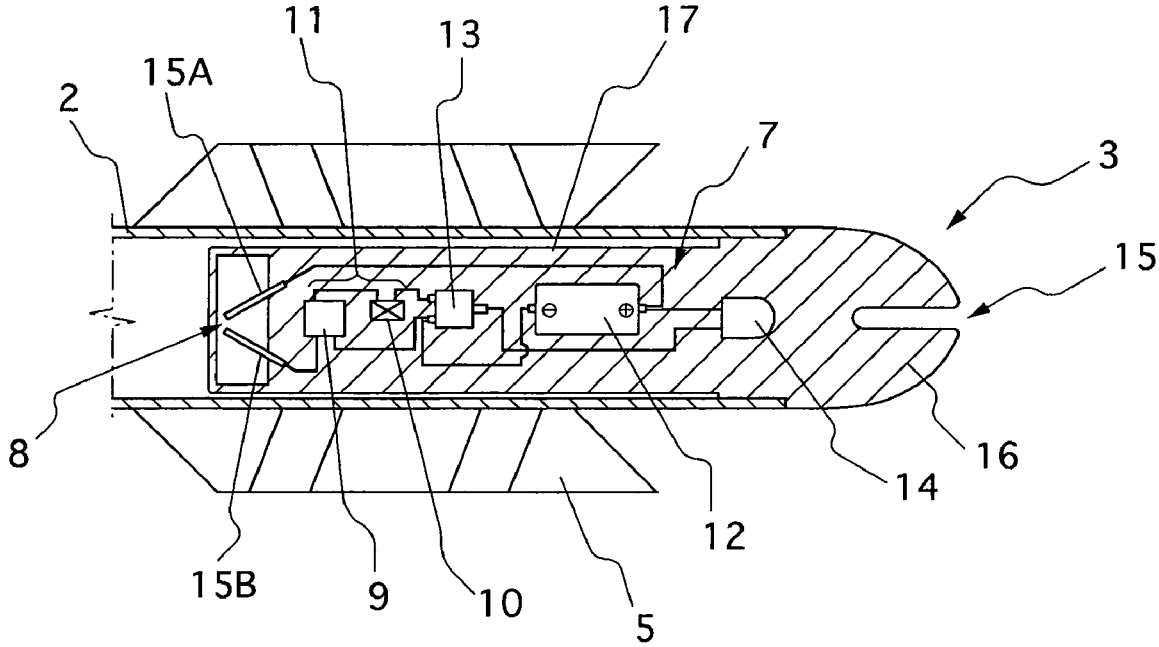
FIG. 4 is a sectional explanatory view showing an example of a nock with a light emitting function to which the invention is applied.

Next, FIG. 4 is a sectional explanatory view showing an example of a nock with a light emitting function to which the invention is applied.

The nock 3 has a nock main body 16 in which a notch 15 for hooking a bowstring is formed, and a light emission control part 7 that makes an LED 14 emit light when the arrow 1 is accelerated by the bow.

This light emission control part 7 is installed by resin molding inside the housing case 17 integrally attached to the nock main body 16. At the arrow 1 front end side inside the housing case 17, an acceleration switch 8 is provided so that its base end is fixed by resin molding. Herein, the acceleration switch 8 is provided in which two thin metal plates 15A and 15B are turned toward the arrow advancing direction and their front ends are separated from each other.

To the acceleration switch 8, as described in detail in the example of the arrow with the light emitting function to which the invention is applied, the lithium battery 12, the capacitor circuit 11 including the capacitor 9 and the resistor 10, the transistor 13, and the LED element 14 are connected.

This LED element 14 is fixed by a molding resin inside the nock main body 16.

The nock main body 16 is formed from a material that transmits light emitted from the LED element 14.

In addition, the nock 3 formed by the nock main body 16 and the housing case 17 with the light emission control part 7 installed inside is attachable to and detachable from the inside of a rear end opening of the arrow shaft 2 of the arrow 1.

Therefore, when the LED element 14 emits light, the light is transmitted through the nock main body 16 and goes outside, whereby the locus of the arrow and the position of shooting the target can be visually checked.

As described in detail in the example of the arrow with the light emitting function to which the invention is applied, in the acceleration switch 8, when the arrow is accelerated by the bow, the two thin metal plates 15A and 15B bend due to inertia and come into contact with each other to temporarily conduct electricity, and charges the capacitor 9 while making the LED element 14 emit light. Furthermore, after the acceleration of the arrow ends and the arrow turns into constant-speed flight, the metal plates 15A and 15B restore due to elasticity of the metal plates and electric conduction is cut off.

Next, electricity charged in the capacitor 9 is discharged through the transistor 13 to make the LED element 14 emit light for a predetermined period of time.

The period of electric conduction between the collector and emitter of the transistor 13 as a period of light emission of the LED element 14 is determined by the period of electric conduction to the base, and can be set by summing the capacitance of the capacitor 9 and the resistance value of the resistor 10.

As a material for the nock main body, other than the material that transmits light, any material or any arrangement can be used as long as it realizes a visual check of the light emitted from the LED element, such as a material that is partially transparent or semi-transparent, or an arrangement in that the light emitted from the LED element is irradiated through a hole opened in the nock main body.

Figure 5:
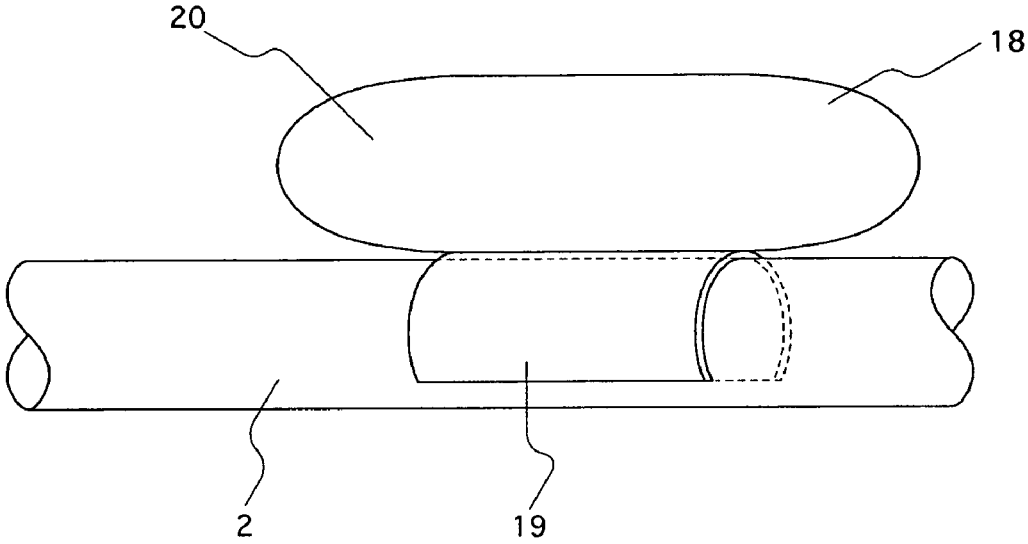
FIG. 5 is a perspective view showing an example of a light emission control device with a light emitting function to which the invention is applied.
Figure 6:
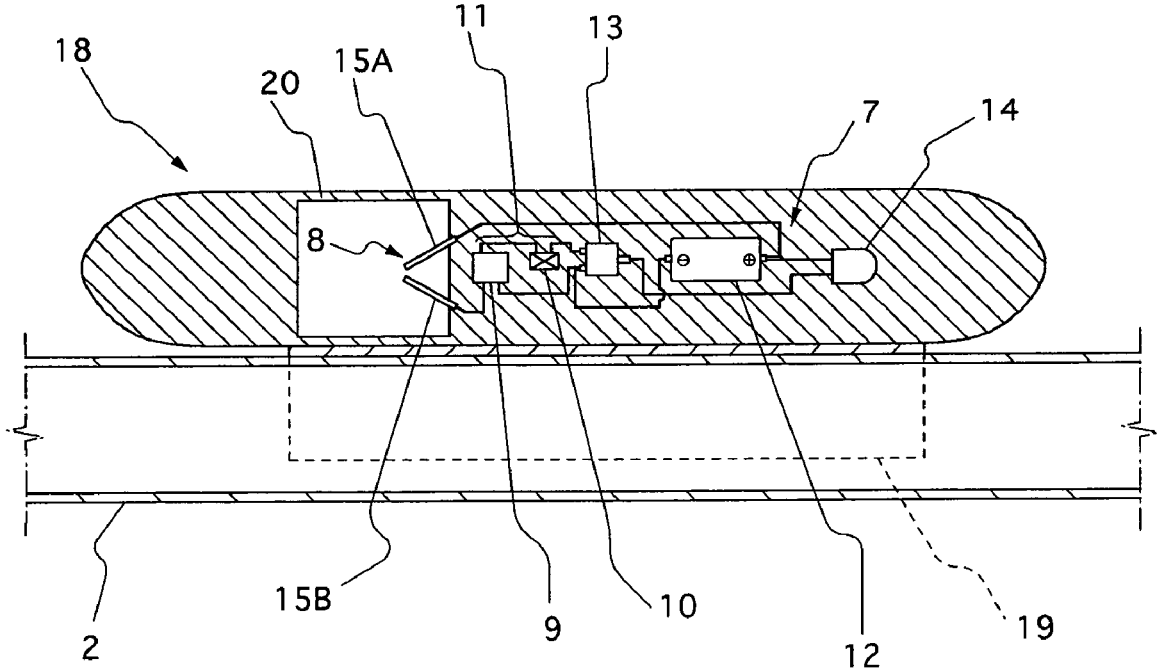
FIG. 6 is an enlarged explanatory view showing the internal mechanism of FIG. 5.
Figure 7:
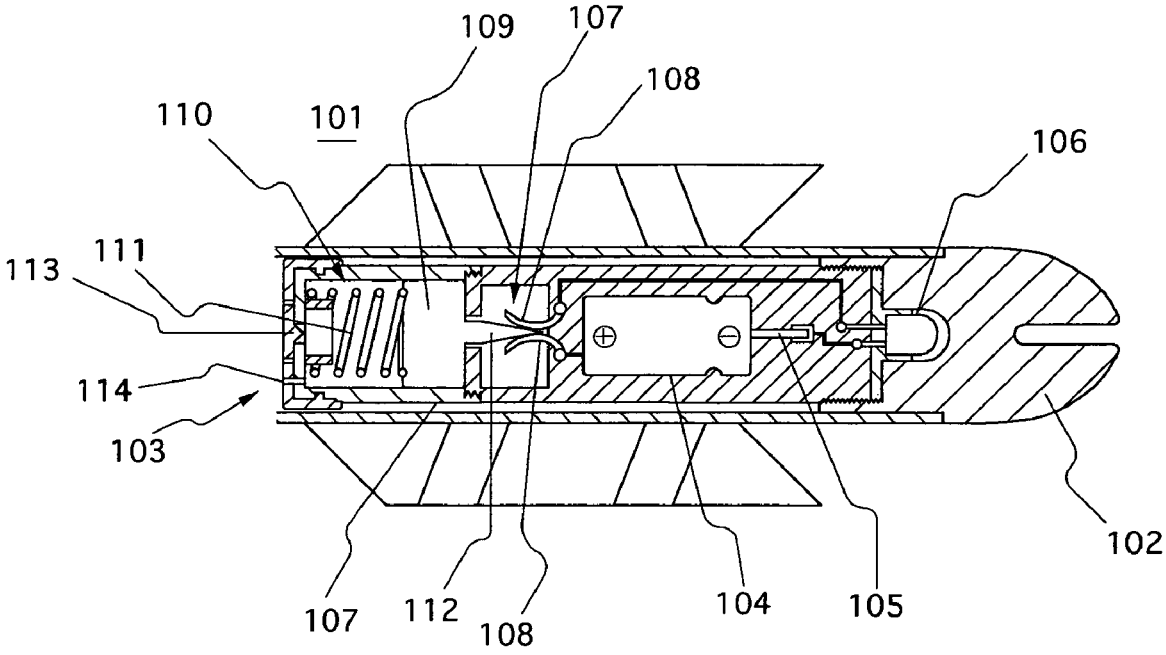
FIG. 7 is a sectional explanatory view showing an example of a nock with a conventional light emitting function.

Furthermore, FIG. 5 is a perspective view showing an example of a light emission control device having a light emitting function to which the invention is applied, and FIG. 6 is an internal enlarged explanatory view showing the internal mechanism of FIG. 5.

The light emission control device 18 shown herein includes an arrow attaching part 19 from a plastic material formed at a lower portion and a light emission control part housing case 20 integrally joined to the upper portion of the arrow attaching part 19.

The arrow attaching part 19 is formed of, for example, a cylinder with a section curved shape smaller than the outer diameter of the arrow shaft 2. The light emission control device 18 can be firmly attached to the arrow 1 by fitting the arrow attaching part to the outer circumference of the arrow shaft 2 while expanding its diameter against the elastic force of the plastic material.

At the arrow 1 front end side inside the light emission control part housing case 20, an acceleration switch 8 is provided. This acceleration switch 8 has a base end fixed by a molding resin and two thin metal plates 15A and 15B turned toward the arrow advancing direction and their front ends are separated from each other.

To the acceleration switch 8, as described in detail in the example of the arrow with the light emitting function to which the invention is applied, the lithium battery 12, the capacitor circuit 11 including the capacitor 9 and the resistor 10, the transistor 13, and the LED element 14 are connected and fixed by a molding resin.

The rear end side of the light emission control part housing case 20 is formed from a material that transmits light (for example, a plastic or the like), and at the rear end side of this light emission control part housing case 20, an LED element 14 is disposed.

Therefore, as described in detail in the example of the arrow with the light emitting function to which the invention is applied, in the acceleration switch 8, when the arrow is accelerated by the bow, the two thin metal plates 15A and 15B bend inward due to inertia and come into contact with each other to temporarily conduct electricity, and charge the capacitor 9 while making the LED element 14 emit light. Furthermore, after the arrow leaves the bow, the metal plates 15A and 15B restore due to elasticity of the metal plates and cut off the electric conduction, however, the electricity charged in the capacitor 9 is discharged through the transistor 13, and makes the LED element 14 emit light for a predetermined period of time, whereby it becomes possible to visually check the locus of the arrow and the position where the arrow hits the target or ground.

The arrow attaching part of the light emission control device, attachable to and detachable from the arrow, does not always need to have the mechanism described in detail in this embodiment, but may have any mechanism as long as it realizes firm and easy attachment, such as a mechanism in which the arrow shaft is inserted through a cylindrical member that is made of a rubber material smaller than the outer diameter of the arrow shaft.

In addition, as a material of the light emission control part housing case, other than the material that transmits light, any material or any arrangement can be used as long as it enables a visual check of the light emitted from the LED element, such as a material that is partially transparent or semitransparent, or an arrangement in which the light emitted from the LED element is irradiated through a hole opened in the rear end.

In addition, the battery is not limited to a lithium battery, and for example, cadmium or alkali batteries can be used, however, a lithium battery that is light in weight and enables downsizing is most preferable.

Furthermore, an arrow to be used for kyudo is described in detail in the embodiment of the invention, however, the invention is also applicable to arrows of archery, bowgun (crossbow), darts, etc., as well as kyudo.

According to the invention constructed as described above, the acceleration switch is turned on by an acceleration applied when the arrow is accelerated by the bow, and the capacitor is charged while making the LED element emit light. Therefore, a shooter can visually check the locus of the arrow even at dusk.

In addition, even when the arrow leaves the bow, the acceleration ends, and the acceleration switch is turned off, light is emitted for several seconds by the LED element by discharge from the capacitor, whereby a shooter can confirm the arrow arrival point, easily judge which direction he/she should discharge the arrow in, and concentrate on the training without losing his/her rhythm.

On the other hand, in matches, the point where the arrow hits can be easily confirmed from a distance, so that a judge can score points from a distance and smoothly advance the match.

Furthermore, the nock is attachable to and detachable from the arrow main body, so that by providing the nock on an existing arrow that a shooter has used, the existing arrow can be used without change. In addition, the light emission control device is attachable to and detachable from an existing arrow, so that a shooter can attach it to an existing arrow when he/she needs it.

DESCRIPTION OF SYMBOLS

1 Arrow
2 Arrow shaft
3 Nock
4 Arrowhead
5 Fletchings
7 Light emission control part
8 Acceleration switch
9 Capacitor
10 Resistor
11 Capacitor circuit
12 Lithium battery
13 Transistor
14 LED element
15A, 15B Metal plate
16 Nock main body
17 Housing case
18 Light emission control device
19 Arrow attaching part
20 Light emission control part housing case

What is claimed is:

1. An arrow with a light emitting function having a light emission control part comprising:

a light emission control part that emits light when the arrow is discharged, said control part including an electrical circuit;

said control part including an acceleration sensor switch that starts by an acceleration of the arrow;

a light source provided at a position enabling a shooter to make a visually check;

a battery that supplies a current to the light source when the acceleration sensor switch starts; and a capacitor circuit to which a current is supplied for a predetermined period of time after the acceleration sensor switch is turned off.

2. The arrow with a light emitting function according to claim 1, wherein the light source is provided in a nock of the arrow.

3. The arrow of claim 1, wherein the acceleration sensor switch closes during acceleration of the arrow and opens when the arrow is not accelerating.

4. The arrow of claim 1, wherein the acceleration sensor switch is comprised of two metal plates, one or both of said metal plates bending toward the other metal plate and closing the acceleration sensor switch when an inertial force acts on the metal plates due to acceleration of the arrow.

5. A nock with a light emitting function provided in an arrow having a light emission control part comprising:

a light emission control part that emits light when the arrow is discharged, said control part including an electrical circuit said control unit including an acceleration sensor switch that starts by an acceleration of the arrow;

a light source provided in the nock;

a battery that supplies a current to the light source when the acceleration sensor switch starts; and a capacitor circuit to which a current is supplied for a predetermined period of time after the acceleration sensor switch is turned off.

6. The nock with a light emitting function according to claim 5, wherein the nock with the light emission control part is attachable to and detachable from an arrow main body.

7. The nock of claim 5, wherein the acceleration sensor switch closes during acceleration of the arrow and opens when the arrow is not accelerating.

8. The nock of claim 5, wherein the acceleration sensor switch is comprised of two metal plates, one or both of said metal plates bending toward the other metal plate and closing the acceleration sensor switch when an inertial force acts on the metal plates due to acceleration of the arrow.

9. A light emission control device with a light emitting function to be attached to an arrow comprising:

an electrical circuit which includes:

an acceleration sensor switch that starts by an acceleration of the arrow;

a light source that emits light when the arrow is discharged;

a battery that supplies a current to the light source when the acceleration sensor switch starts; and a capacitor circuit to which a current is supplied for a predetermined period of time after the acceleration sensor switch turned off.

10. The light emission control device with a light emitting function according to claim 9, wherein the light emission control device is attachable to and detachable from an arrow main body.

11. The light emission control device of claim 9, wherein the acceleration sensor switch closes during acceleration of the arrow and opens when the arrow is not accelerating.

12. The light emission control device of claim 9, wherein the acceleration sensor switch is comprised of two metal plates, one or both of said metal plates bending toward the other metal plate and closing the acceleration sensor switch when an inertial force acts on the metal plates due to acceleration of the arrow.

* * * * *